United States Patent [19]

Koberlein

[11] Patent Number: 4,512,137

[45] Date of Patent: Apr. 23, 1985

[54] BREAD LOAF PROCESSING

[75] Inventor: Ross D. Koberlein, Brownstown, Ill.

[73] Assignee: Bettendorf Stanford Inc., Salem, Ill.

[21] Appl. No.: 414,478

[22] Filed: Sep. 2, 1982

[51] Int. Cl.[3] ..... B65B 25/18; B65B 35/58; B65B 63/00; A21C 15/04

[52] U.S. Cl. ..... 53/435; 53/446; 53/516; 53/544; 83/35; 83/105; 83/407; 198/399

[58] Field of Search ..... 53/435, 446, 469, 513, 53/516, 517, 544; 83/35, 102, 105, 404.2, 407; 198/399, 374, 415

[56] References Cited

U.S. PATENT DOCUMENTS 2,247,401 6/1941 Papendick ..... 53/516
2,247,675 6/1941 Thum ..... 198/399
2,332,316 10/1943 Hexter ..... 53/516
2,389,812 11/1945 Papendick ..... 198/374

FOREIGN PATENT DOCUMENTS 430888 6/1935 United Kingdom ..... 83/105

*Primary Examiner*—Robert L. Spruill
*Assistant Examiner*—Richard M. Mudd
*Attorney, Agent, or Firm*—Polster, Polster and Lucchesi

[57] ABSTRACT

Method and apparatus by which bread loaves or the like are split in half, and thereafter turned mechanically through 180° with respect to one another so that the heel and cut ends of both of the two half loaves are oriented in the same way. The half loaves are thereafter sliced and then packaged in separate packages but in the same orientation with respect to each package.

7 Claims, 3 Drawing Figures

BREAD LOAF PROCESSING

BACKGROUND OF THE INVENTION

Sliced bread is now packaged commercially in half loaves, for the convenience of individuals and small families. Heretofore, to package the half loaves so that each is in the same orientation with respect to the package, the whole loaves have been sliced, and the sliced loaves have been divided by hand, turned, and then packaged. This is an expensive and inefficient process.

One of the objects of this invention is to provide method and apparatus for processing a bread loaf automatically to permit its being packaged in two halves in separate packages, with the halves oriented in the same direction with respect to each package, in a simple and economical way.

Other objects will become apparent to those skilled in the art in the light of the following description and accompanying drawing.

SUMMARY OF THE INVENTION

In accordance with this invention, generally stated, method and apparatus for slicing and packaging bread are provided wherein a whole bread loaf is first split in half, one half-loaf is turned mechanically through 180° with respect to the other half so that the heel and cut ends of both of the two half loaves are oriented in the same way, the two half loaves are sliced (cut into slices) and the sliced half loaves are packaged in separate packages but in the same orientation with respect to each package. The method and apparatus of this invention are described as applied to bread loaves, but they may be utilized for other purposes, as, for example, processing and packaging lunch meats.

DESCRIPTION OF THE PREFERRED EMBODIMENT

Figure 1:
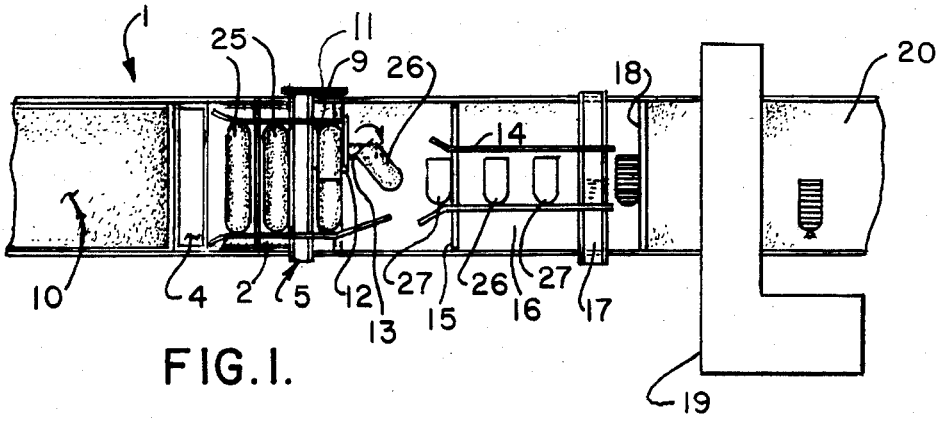
FIG. 1 is a somewhat schematic view in top plan of loaf processing apparatus of this invention.
Figure 2:
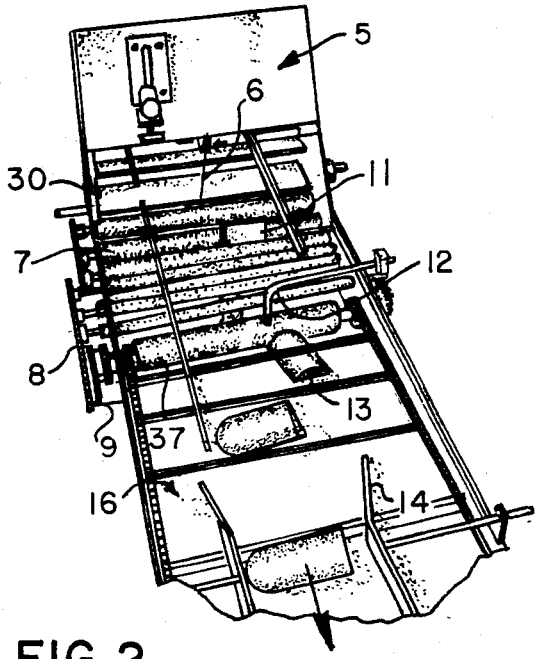
FIG. 2 is a fragmentary view in perspective of a portion of the apparatus shown in FIG. 1 from the following side of a splitter saw.
Figure 3:
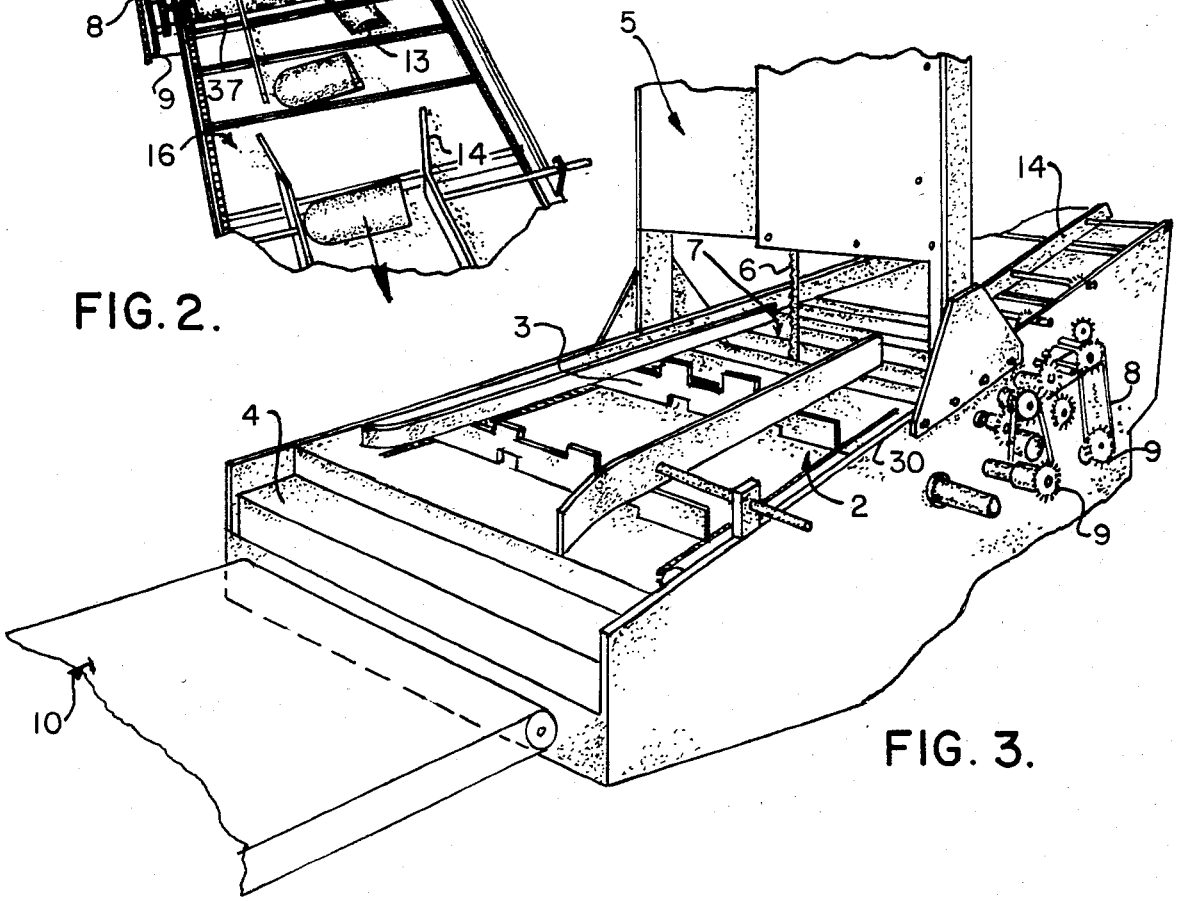
FIG. 3 is a fragmentary view in perspective from the feed side of the splitter saw.

Referring not to the drawing for one illustrative embodiment of apparatus of this invention, reference numeral 1 indicates a processing line, including a standard belt conveyor 10 feeding a chain driven flight conveyor 2. An elevator 4 between the belt conveyor 10 and the flight conveyor 2 serves to coordinate the loaves with flights 3 of the conveyor 2. The flights 3 feed loaves 25 to a band saw-type splitter 5, a blade 6 of which is positioned in the center, transversely of the conveyor, and perpendicularly to the surface, of the conveyor. Each loaf 25 is pushed by a flight partway through the saw blade, and the rest of the way, by the following loaf.

Conveying rollers 7, on the following side of the saw blade 6 are driven by chains 8 extending around sprockets 9, one of which is a drive sprocket driven by a drive sprocket of a chain-driven flight type slicer conveyor 16, which in turn is driven by a bagger drive, the drive motor of which is not here shown. A roller 37 is mounted on a shaft connecting opposite sprockets driving the chains of the conveyor 16, and serves as the last of the conveying rollers on the following side of the saw blade 6. A timing half loaf dwell plate 11 restrains one half 26 of the split loaf, permitting the other half 27 to clear sufficiently to accommodate the restrained half 26 when it is released. A pivot bar 12 is positioned to engage the side of the half loaf 26 adjacent its cut end. A turning roller 13, which in this illustrative embodiment is driven by friction engagement with the roller 37 of the conveyor 16, is oriented with its axis of rotation at an angle to the axis of rotation of the roller 37, whereby the "restrained" half loaf 26 is turned through an obtuse angle when it is released by the dropping of the dwell plate 11 and moved forward by the conveying rollers 7 and 37. The partly turned half loaf is turned to the desired orientation, at right angles to the direction of travel of the flights of the conveyor, by a flight 15 by which it is conveyed. As it moves, it is guided to the same side of the conveyor as the half loaf 27 that went straight through, by guide rails 14 and 24, the half loaves now being oriented with both cut ends in the same direction, and lined up one behind the other, and the two half loaves are conveyed through a slicer 17. The sliced half loaves, synchronized by a bagger dwell plate 18, are fed to a bagger 19, thence to a loading conveyor 20.

The conveyors 2, 16 and 20, the slicer and bagger are conventional. Except for the width and position of the half loaf dwell plate 11, the dwell plates and elevator are also conventional, and are reciprocated vertically by conventional timing devices.

The novel elements of the apparatus in the combination by which the method of the invention is accomplished are the single splitting blade preceding the slicer, and the means by which the split halves of the loaf are oriented in the same direction before they pass through the slicer. The novel aspect of the method lies in first splitting the loaf in half, then mechanically orienting the two halves in the same direction, thereafter slicing the two identically oriented halves and packaging the halves in the same orientation in each package.

Numerous variations in the apparatus and method of this invention within the scope of the appended claims, will occur to those skilled in the art in the light of the foregoing disclosure. As is readily apparent, by relocating the pivot bar 12 and the turning roll 13, either half of the split loaf can be turned, so that either side of the conveyor can be utilized. In the illustrative embodiment shown, the loaves 25 are illustrated as being elongated. The apparatus can be modified to accommodate round loaves, for example. In the illustrative embodiment, one half of each loaf is turned 180° with respect to the other, to permit a straight line flow. Both halves can be turned 90°, and transferred to a conveyor moving at right angles to the direction of travel of the half loaves. The turning roller 13 is shown as cylindrical with parallel sides. It can be made in the form of a truncated cone, or set at a different angle, or both. Other means for turning one or both of the half loaves can be provided, such as a chain, a turntable or a pusher. A reciprocating saw can be used instead of band saw 5. One of the advantages of the apparatus shown and described, is that by merely removing the blade 6 of the splitter and the pivot bar 12, and disabling the dwell plate 11 and turning roller 13, the system can be used conventionally for slicing and bagging whole loaves. It can be seen, however, that other drive arrangements and the like, which do not lend themselves as readily to removal but do not require that all of the components be driven from the bagger motor, can be used. These are merely illustrative.

I claim:

1. The process of processing a bread loaf or the like comprising splitting said loaf in half to produce a cut end and a heel end of each half loaf, thereafter turning one of said half loaves mechanically through 180° with respect to the other so that the heel and cut ends of both of the two half loaves are oriented in the same direction, cutting the two half loaves into slices, and packing said sliced half loaves in separate packages but in the same orientation with respect to each package.

2. The method of claim 1 wherein the loaves are enlongated and are split transversely of their length.

3. The method of claim 1 wherein the packages are bags and each half loaf is inserted in a bag with the cut end away from the open end of the bag.

4. Apparatus for slicing and packaging bread loaves or the like comprising means for conveying loaves through a straight reach, a splitter mounted to split into halves loaves being conveyed by said conveying means to produce a cut end and a heel end of each half loaf, turning means for rotating one of said half loaves through 180° with respect to the other so that the heel and cut ends of the two half loaves from each loaf are oriented in the same direction, slicing means mounted for cutting said half loaves into slices, and packaging means for packaging said sliced half loaves in the same orientation with respect to each package.

5. The apparatus of claim 4 wherein the loaves are elongated and the conveying means carries said loaves with their long dimension oriented transversely of the direction of their travel, and said splitter is mounted to split said loaves transversely of the long dimension of said loaves.

6. The apparatus of claim 4 wherein the packaging means is a bagger, each of said half loaves being inserted with the cut end away from the open end of the bag.

7. The apparatus of claim 4 wherein the turning means comprises driven roller means for engaging half loaves intermediate the length of their travel on said conveying means, said roller means being mounted for rotation on an axis set at an angle to the direction of travel of said half loaves as they approach said roller means.

* * * * *